United States Patent [19]

Weidler

[11] 4,408,824

[45] Oct. 11, 1983

[54] WIRE-IN-SLOT TERMINAL

[75] Inventor: Charles H. Weidler, Lancaster, Pa.

[73] Assignee: AMP Incorporated, Harrisburg, Pa.

[21] Appl. No.: 271,468

[22] Filed: Jun. 8, 1981

[51] Int. Cl.[3] ..... H01R 11/22

[52] U.S. Cl. ..... 339/258 R; 339/278 C

[58] Field of Search ..... 339/258 R, 258 P, 259 R, 339/278 C

[56] References Cited

U.S. PATENT DOCUMENTS

| | | | |
|---|---|---|---|
| 3,676,829 | 7/1972 | Gartland, Jr. et al. | 339/259 R X |
| 3,768,068 | 10/1973 | Palecek | 339/221 D |
| 3,850,500 | 11/1974 | Cobaugh et al. | 339/258 R |
| 3,874,769 | 4/1975 | Simon | 339/217 S |
| 4,100,385 | 7/1978 | Wutz | 339/278 C X |
| 4,138,604 | 2/1979 | Harmsen et al. | 339/278 C |
| 4,159,158 | 6/1979 | Weidler | 339/97 P |
| 4,219,252 | 8/1980 | Fischer | 339/259 R |

*Primary Examiner*—Howard N. Goldberg
*Attorney, Agent, or Firm*—Frederick W. Raring

[57] ABSTRACT

Electrical contact terminal comprises an elongated metal strip which has been folded along a medial transverse fold line to form two side-by-side arms. A wire-receiving slot is provided at the fold. The arms have parallel portions adjacent to the fold and converging portions extending from the parallel portions. Contact zones are provided on the ends of the converging portions. A brace extends between the arms and restrains movement of the arms away from each other. The location of the brace determines the contact force exerted on the complementary mating terminal device. The terminal is manufactured in strip form and in a condition such that the contact zones are spaced apart when the terminals are attached to the strip. The contact zones can therefore be plated with a conductive metal.

9 Claims, 6 Drawing Figures

WIRE-IN-SLOT TERMINAL

FIELD OF THE INVENTION

This invention relates to stamped and formed electrical contact terminals of the general type having a pair of converging arms which are intended to receive a complementary terminal blade or post between their opposed surfaces. The invention is particularly related to the control of the contact force developed in the arms and to the provision of plated metal on the contact zones of the terminal.

BACKGROUND OF THE INVENTION

U.S. Pat. No. 4,159,158 describes an electrical contact terminal which comprises an elongated section of sheet metal which is folded, with respect to transverse fold lines, to provide side-by-side coextensive arms. The arms have convergent portions and have opposed contact zones on the convergent portions so that a post or blade can be inserted between the arms and the arms will establish electrical contact with the post or blade. The terminal of the above identified U.S. patent is connected to a wire by means of a wire-receiving slot which extends into the folded portion of the terminal.

Terminals of the general type shown in U.S. Pat. No. 4,159,158 are widely used in many different forms. The convergent arms between which the complementary terminal is received are easily produced in sheet metal terminals and under many circumstances will provide adequate contact pressure for a stable electrical connection. The contact pressure which is developed in terminals of this type is largely dependent upon the dimensions of the arms and the physical properties of the material from which the terminal is produced. If the arms are relatively long, it is necessary to use fairly thick material having good spring characteristics to develop an adequate contact pressure. Under some circumstances, the spring arms can be supported by the walls of the housing in which the terminal is contained for the purpose of increasing the contact pressure but this expedient is not always satisfactory for the reason that the housing is usually of a thermoplastic material and it may relax after the passage of time with a resulting relaxation of the contact force. The present invention, in accordance with one aspect thereof, is directed to the achievement of a stamped and formed contact terminal having side-by-side arms and having a bracing means extending between the arms which permits control of the contact force developed by the spring arms.

In accordance with a further aspect thereof, the invention is directed to the achievement of a terminal having spring arms which have contact zones adjacent to their ends, the contact zones being preloaded against each other. When a terminal of this type is plated with a conductive corrosion resistant material, such as gold or tin, it is essential that the plating cover the contact zones, since these zones are the most critical parts of the terminal. If the terminal is plated after complete forming thereof, the plating metal will obviously not be deposited on contact zones which are against each other. The invention is further directed to the manufacture of terminals having their contact zones against each other and having plating metal completely covering these contact zones.

A contact terminal in accordance with the invention comprises an elongated section of conductive sheet metal which is folded about medial transversely extending fold lines to form two side-by-side coextensive arms. A wire connecting portion is provided at the fold in the form of wire-receiving slots into which the wire is inserted. The arms have parallel portions extending from the fold and the arms have convergent portions extending from the ends of the parallel portions. The convergent portions extend to contact zones on the opposed surfaces of the arms. The contact zones are against each other and are preloaded, that is, resiliently stressed so that a minimum contact force is established when a blade or post is inserted between the arms. A brace is provided which extends between the arms at a location spaced from the contact zones. This brace restrains the arms against outward movement so that when the blade is inserted between the contact zones, the portions of the arms which extend from the brace to the contact zones function as cantilever beams. The stresses developed in these beams upon insertion of the blade further contribute to the contact force which is developed when the blade is fully inserted.

Terminals in accordance with the invention are manufactured in strip form with each terminal extending from a continuous carrier strip. When the terminals are in strip form, the contact zones are not against each other and the brace is disengaged so that the terminals can be plated and plating metal will be deposited on the contact zones. When the individual terminals are removed from the strip and inserted into a connector housing, the brace is engaged and the arms are flexed so that the contact zones are against each other and preloaded against each other.

PREFERRED EMBODIMENT OF THE INVENTION

Figure 1:
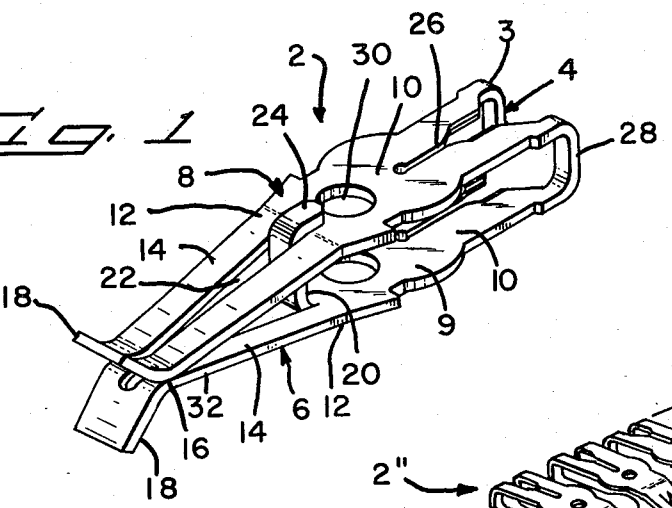
FIG. 1 is a perspective view of an electrical contact terminal in accordance with the invention.
Figure 5:
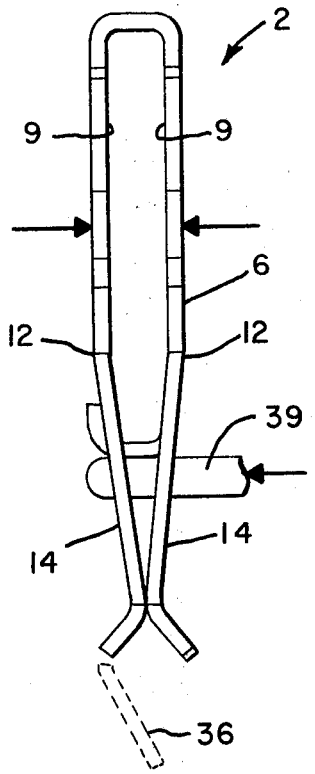
FIG. 5 is a view similar to FIG. 4, illustrating the manner in which the arms of a terminal are latched together by the brace.

Referring first to FIGS. 1 and 5, a terminal 2 in accordance with the invention comprises a wire connecting portion 4 at one end thereof and a pair of coextensive arms 6, 8 which extend from the wire connecting portion. The ends of the arms are joined by spaced-apart strap members 28 and the terminal is connected to a wire 60 by means of slots 26 which extend inwardly from the end 4.

Figure 2:
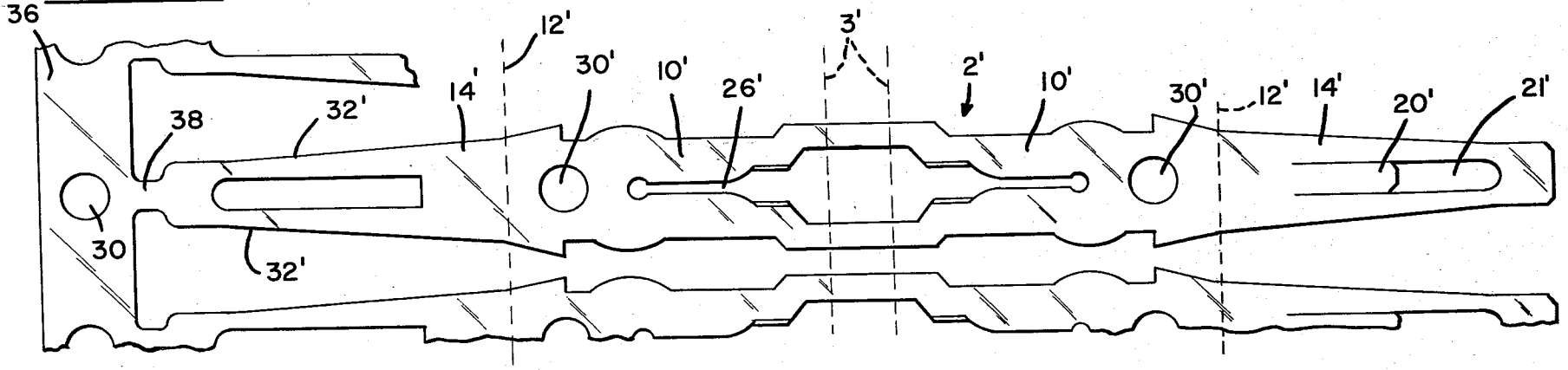
FIG. 2 is a plan view of a short section of strip having flat blanks attached thereto which are formed to produce terminals as shown in FIG. 1.

The arms 6, 8 have opposed major surfaces 9 and have intermediate parallel portions 10 which extend from the connecting portion 4 to transition sections 12. Converging portions 14 of the arms extend from the transition sections 12 to contact zones 16 which are on the opposed major surfaces 9. The ends of the arms diverge from the contact zones as shown at 18 so that a complementary terminal device, such as a blade or post, will be guided between the arms 6, 8. The side edges of the converging portions 14 of the arms taper towards each other as shown at 32 and at 32', FIG. 2. As will be explained below, the portions 14 of the arms function as cantilever beams and the tapered side edges 32 of the convergent arms determine to some extent the behavior of these beams when they are stressed.

A brace is provided which extends between the arms and which restrains them against movement away from each other normally of their own planes. This brace is in the form of a lance 20 which is struck from the arm 6 and which extends through an opening 22 in the arm 8. The end portion 24 of this lance is bent laterally toward the wire connecting portion 4 of the terminal so that movement of the arms 6, 8 in opposite directions and away from each other will be resisted by the lance. As a result, only the portions of the arms which extend from the lance 20 to the contact zone 16 are flexed when the blade is inserted between the arms. As will be explained below, the converging portions 14 of the arms are preloaded towards each other; that is, they are in a flexed condition in the terminal as shown in FIG. 1 so that the contact zones 16 are likewise pressed against each other with a predetermined contact force. The manner of achieving this condition will be explained below. At this point, it whould be explained that if the terminal is provided with a conductive metal plating, the plating will also completely cover the contact zones 16 notwithstanding the fact that these zones are against each other.

Figure 3:
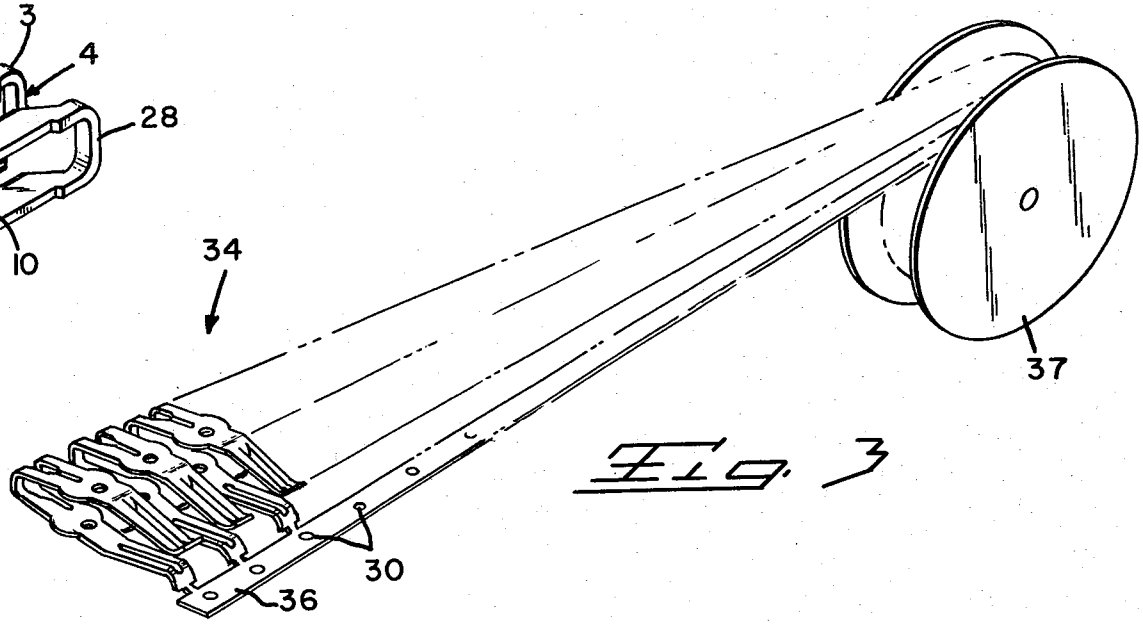
FIG. 3 is a perspective view of a section of formed strip extending from a reel, the terminals in this view being formed but not being latched in their final condition by the brace means.
Figure 4:
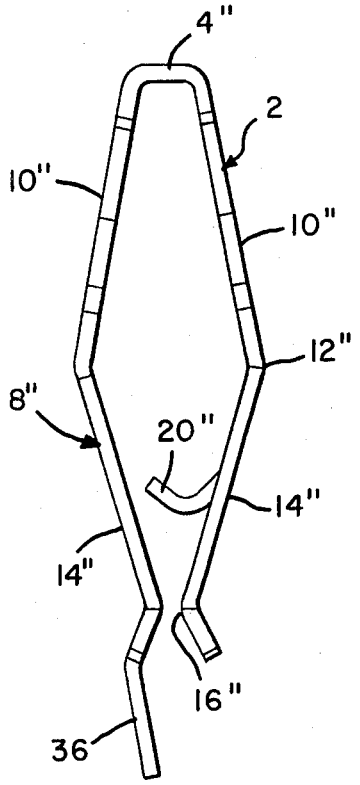
FIG. 4 is an end view of a terminal in the strip of formed terminals.

Terminals as shown in FIG. 1, are manufactured by die stamping and forming to produce a continuous strip 34 of terminals, FIG. 3, which may be wound on reel 37. The individual terminals extend from a carrier strip 36 having spaced-apart pilot holes 30. The strip 36 is produced from a strip of flat terminal blanks shown in FIG. 2 and having individual terminal blanks 2' extending from one side edge of the carrier strip 36. The individual blanks are connected to the carrier strip by connecting sections 38 and are in side-by-side spaced-apart relationship. The reference numerals which were used to describe the finished terminal of FIG. 1 are also applied to the blank shown in FIG. 2 and are differentiated by prime marks. It will be apparent that each blank is folded along fold lines, as indicated at 3', to produce partially formed terminals as shown in FIG. 4. The blanks are also bent along bend lines shown at 12' so that the portions 14'' of the formed terminals, shown in FIG. 4, will extend convergently towards each other. In FIG. 4, the same reference numerals as were previously used are applied to the parts of the terminal, but are differentiated in this instance by double prime marks. It will be seen from FIG. 4 that the intermediate portions 10'' adjacent to the transition section 12'' extend divergently from each other and that the lance 20'' is spaced from the surface of the righthand arm portion 14''. The contact zones 16'' are spaced apart so that the terminal strip 34 can then be passed through a plating bath and plating metal will be deposited on the contact zones 16'.

Figure 6:
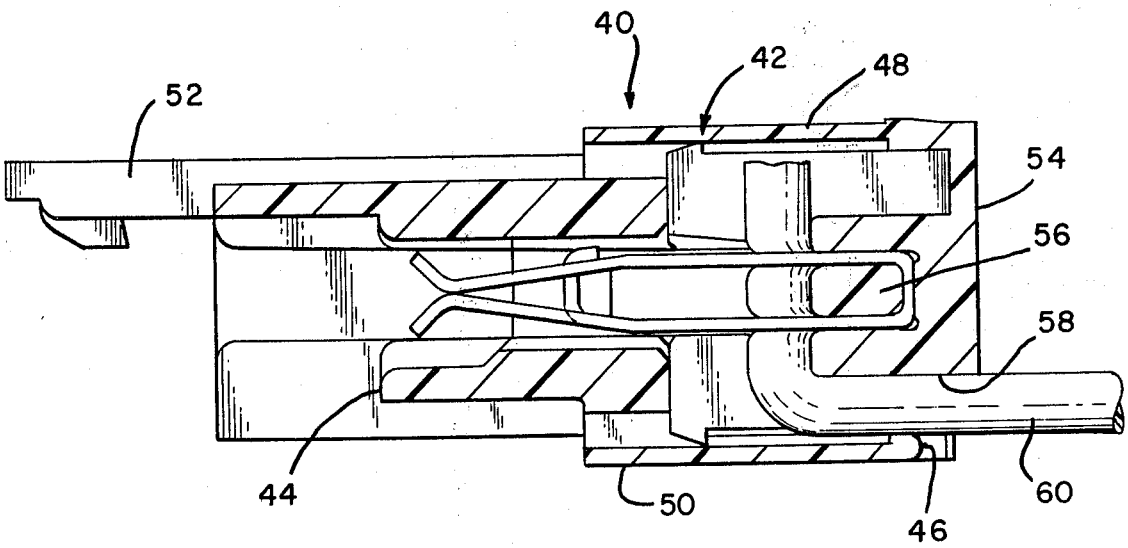
FIG. 6 is a cross-sectional view of a connector having a terminal contained therein which is connected to the end of a wire.

When the terminals are removed from the carrier strip 36 and inserted into a connector housing, such as the housing shown in FIG. 6, it is necessary to flex the portions 10'' of each terminal towards each other until they are parallel as shown in FIG. 5. During movement of the arms from the positions of FIG. 4 to the positions of FIG. 5, the lance 20'' will move through the opening 22 in the arm 8''. A tool 39 can then be passed through the opening 21 in the arm 6 to bend this lance upwardly to the position shown in FIG. 5 and finally set lance so that it will restrain the arms against movement from each other.

FIG. 6 shows a terminal in accordance with the invention mounted in a connector 40. The connector comprises an insulating housing 42 having a mating face 44, a wire entry face 46, and upper and lower sidewalls 48, 50. A latch arm 52 extends forwardly beyond the mating face 44 for engagement with a complementary connecting device, not shown. The housing is open at its wire entry end 46 and a plug member 54 is fitted in this open end to retain the wire 60 in the slot 6 of the terminal. The plug has portions 56 which extend between the connecting straps 28 and which retain the wire in the slots. The plug has a recess 58 on its lower side and the wire extends through this recess and from the rightwardly facing surface of the plug 54. It will be understood that terminals as shown in FIG. 1 can, however, be used in a variety of types of connector housings.

A significant advantage of the invention is that the contact force which is developed in the converging portions 14 of the arms 6, 8 can be closely controlled and can be raised to high levels if desired, by the lance 20. The presence of the lance in the terminal ensures that the converging portions 14 of the arms will function as cantilever beams when a blade or post is inserted between the arms. The force which is required to deflect a cantilever beam is given by the following formula.

$$p = \frac{Ef\,b_o\,t^3}{4\,l^3\,k}$$

where:
p=force
f=deflection
E=elastic modulus
$b_o$=width of beam at fixed end
b=width of beam at loaded end
t=thickness of the material
l=length
$k=b/b_o$ It will be apparent from this formula that if the deflection f, the beam width $b_o$, b, and the material thickness t are held constant, the force p will be inversely proportional to the cube of the length l. It follows that a terminal constructed in accordance with the invention can be adjusted for varying contact force requirements by simply changing the location of the lance 20, since the length, l, in the formula given above is the distance between the lance 20 and the contact zones 16 of the terminal. A designer of terminals can therefore achieve a desired contact force which will lie within a wide range of possible contact forces and he can achieve the desired contact force without changing the dimensions of the terminal, the thickness of the material, or the nature of the material itself. That is, he need not substitute a material having superior physical properties in order to raise the contact force of the terminal.

A further advantageous feature is that conductive metal plating can be provided on the contact zone 16 notwithstanding the fact that these zones are against each other when the terminal is installed in the housing 42. The preloading of the diverging portions of the arm 14 is also desirable under many circumstances and it too can be adjusted to varying levels during manufacture, as required by circumstances.

There are a wide variety of terminals having converging arms, as shown in FIG. 1, and a brace or lance as disclosed herein can be used in many of these terminals to advantage. For example, U.S. Pat. No. 3,155,449 shows a widely used terminal having a crimped connection rather than a wire slot connection for connecting the terminal to a wire. This terminal has converging arms, however, on which a brace can be provided. I claim:

1. A stamped and formed sheet metal electrical contact terminal of the type comprising a wire connecting portion which is intended to receive, and establish electrical contact with a wire, a pair of side-by-side arms extending from said connecting portion, said arms having opposed major surfaces and having converging portions, contact zones on said opposed surfaces at the ends of said converging portions, and end portions which extend from said contact zones to the free ends of said arms, said arms being flexible in opposite directions away from each other and normally of said major surfaces upon movement of a complementary terminal between said arms whereby said contact zones engage said complementary terminal and establish electrical contact therewith, said contact terminal being characterized in that:

a brace extends between said contact arms at a location between said wire connecting portion and said contact zones, said brace being formed from at least one of said arms and functioning to restrain said arms against movement away from each other, the brace comprising a lance struck from one of the arms and extending along the length of the one arm, the lance extending laterally to the other arm and being secured to the other arm, the portions of said arms which extend from said brace to said contact zones being cantilever beams, each of said beams having a fixed end at said brace and having an effective length which extends from said brace to said contact zone.

2. An electrical contact terminal as set forth in claim 1, said contact zones being against, and in contact with, each other, said terminal having an electro-deposited plating of conductive metal on portions thereof including said contact zones.

3. An electrical contact terminal as set forth in claim 2, said arms being preloaded against each other.

4. An electrical contact terminal as set forth in claim 3, said arms having intermediate portions which are between said connecting portion and said converging portions, said intermediate portions being in parallel side-by-side positions with respect to each other, said intermediate portions being displaced from normal positions, in which said intermediate portions diverge, to said parallel positions, said intermediate portions being held in said parallel positions by said brace, said converging portions being displaced towards each other as a result of the displacement of said intermediate portions and said contact zones being preloaded against each other as a result of the displacement of said converging portions.

5. An electrical contact terminal as set forth in claim 4, said terminal comprising an elongated strip of conductive sheet metal having a folded portion substantially midway between its ends, said arms extending from said folded portion, said wire connecting portion comprising a wire receiving slot in said folded portion.

6. An electrical contact terminal as set forth in claim 5, said other arm having an opening therein, said lance extending through said opening, the end of said lance being bent laterally and bearing against the external surface of said other arm.

7. A stamped and formed sheet metal electrical contact terminal of the type comprising a wire connecting portion which is intended to receive, and establish electrical contact with a wire, a pair of side-by-side arms extending from said connecting portion, said arms having opposed major surfaces and having converging portions, contact zones on said opposed surfaces at the end of said converging portions, and end portions which extend from said contact zones to the free ends of said arms, said arms being flexible in opposite directions away from each other and normally of said major surfaces upon movement of a complementary terminal between said arms whereby said contact zones engage said complementary terminal and establish electrical contact therewith, said contact terminal being characterized in that:

said arms have intermediate portions which are between said connecting portion of said terminal and said converging portions of said arms, said intermediate portions being divergent from said wire connecting portion, said arms have unengaged brace means at a location between said wire connecting portion and said contact zones, said brace means being engagable upon flexing of said arms towards each other to move said intermediate portions to parallel positions, said brace means being effective, upon engagement, to hold said intermediate portions in said parallel positions, said unengaged brace means comprising a lance formed from one of said arms and extending towards the other one of said arms, an opening in said other arm located to receive said lance when said arms are moved towards each other, the end portion of said lance being deformable after movement thereof through said opening to secure said end portion to said other arm, said opposed contact zones being spaced apart, said zones being movable towards and against each other upon movement of said intermediate portions of said arms to said parallel positions whereby, said contact zones can be plated with conductive contact metal and upon movement of said intermediate portions to said parallel positions and engagement of said brace means, said contact zones will be against and in contact with, each other.

8. A stamped and formed electrical contact terminal as set forth in claim 7, said terminal being integral with, and extending laterally from a continuous carrier strip, said carrier strip having a plurality of additional contact terminals extending therefrom which are identical to said terminal.

9. An electrical contact terminal as set forth in claim 8, said terminal comprising an elongated strip of conductive sheet metal having a folded portion substantially midway between its ends, said arms extending from said folded portion, said wire connecting portion comprising a wire receiving slot in said folded portion.

* * * * *